United States Patent [19]

Curtiss

[11] 4,232,414

[45] Nov. 11, 1980

[54] FREE-WHEELING OVERSPEED GRINDER DEVICE

[75] Inventor: George R. Curtiss, Chardon, Ohio

[73] Assignee: Cooper Industries, Inc., Houston, Tex.

[21] Appl. No.: 923,163

[22] Filed: Jul. 10, 1978

[51] Int. Cl.[3] ..... B24B 23/00

[52] U.S. Cl. ..... 51/134.5 F; 51/170 PT; 192/48.3; 192/48.92; 192/46; 192/DIG. 2

[58] Field of Search ..... 192/45, 48.92, 48.3, 192/DIG. 2, 46, 41 A; 51/134.5 R, 134.5 F, 170 R, 170 PT, 170 T

[56] References Cited

U.S. PATENT DOCUMENTS

| | | | |
|---|---|---|---|
| 1,114,304 | 10/1914 | Stanley | 192/46 |
| 1,666,766 | 4/1928 | Alspaugh | 192/48.3 |
| 2,055,803 | 9/1936 | Rafter | 192/48.3 |
| 2,072,058 | 2/1937 | Bauen | 192/48.3 |
| 2,097,944 | 11/1937 | Casey | 51/134.5 |
| 2,898,709 | 8/1959 | Bednarski | 51/134.5 |
| 3,364,625 | 1/1968 | Sogge | 51/134.5 |

*Primary Examiner*—Harold D. Whitehead

*Attorney, Agent, or Firm*—Wilson, Fraser, Barker & Clemens

[57] ABSTRACT

A portable grinder incorporates a safety clutch mechanism between the drive motor output and the grinding wheel shaft to prevent the grinding wheel from dislodging due to a malfunction of the motor. In the preferred embodiment, the clutch mechanism comprises a one-way or a free-wheeling clutch and a slip clutch in parallel between the motor rotor and the drive shaft. The one-way clutch transfers power from the motor rotor to the drive shaft and grinding wheel under normal operating conditions. In the event of a motor malfunction which suddenly locks the rotor, the clutch mechanism allows the drive shaft and grinding wheel to slow and stop in a controlled fashion thereby minimizing the possibility of the grinding wheel dislodging from the drive shaft.

5 Claims, 6 Drawing Figures

FIG. 5
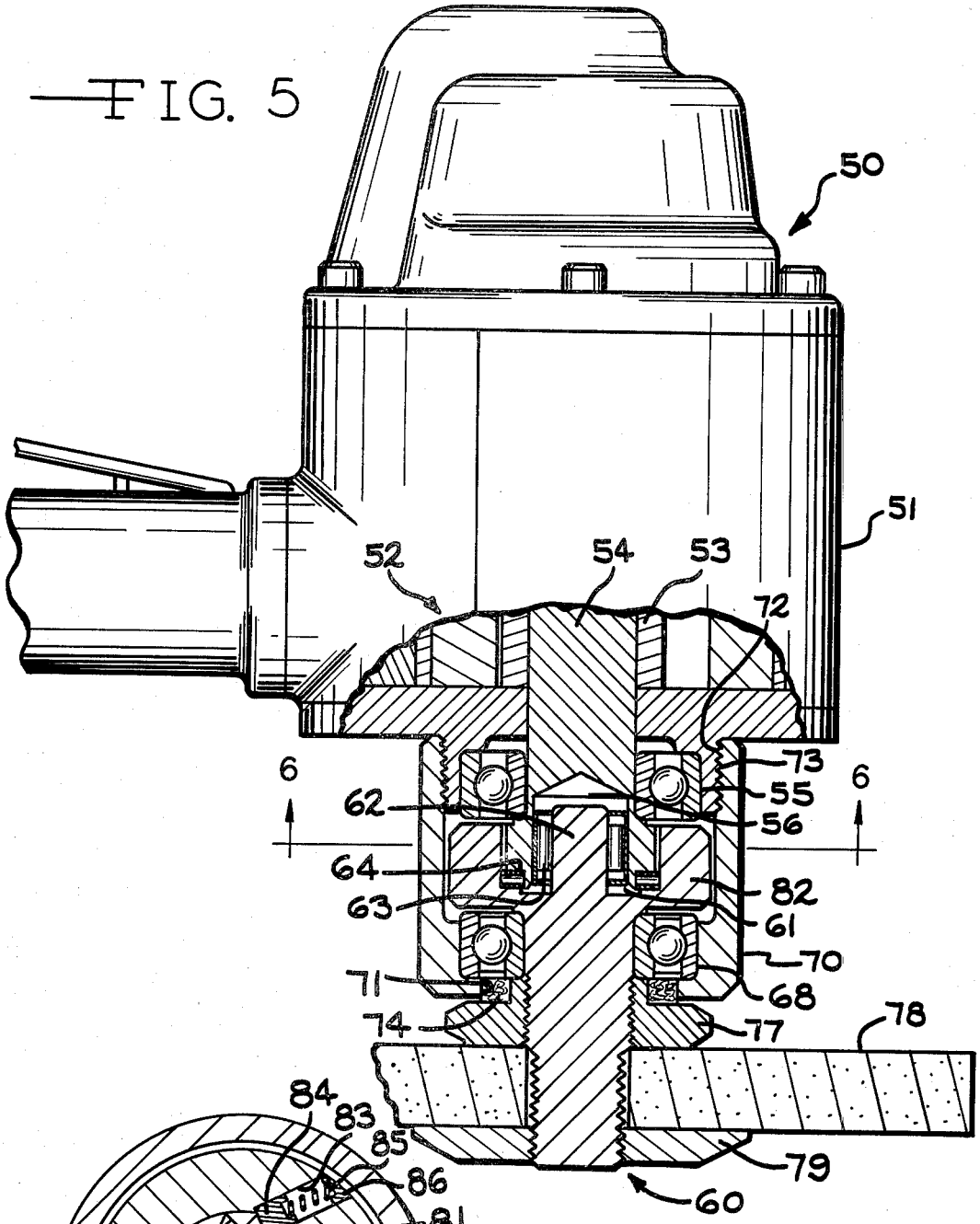
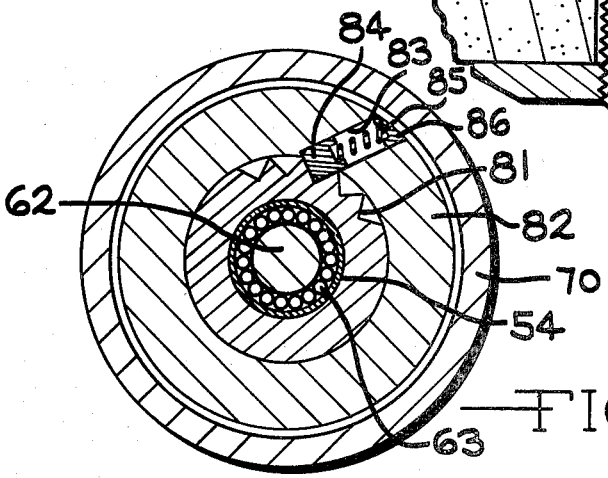
FIG. 6

FREE-WHEELING OVERSPEED GRINDER DEVICE

BACKGROUND OF THE INVENTION

The mobility and light weight of hand-held powered grinding wheel tools has popularized them in a wide variety of production line tasks such as deburring castings, smoothing weldments and shaping surfaces. Such portable grinders are generally denominated vertical grinders. A conventional vertical grinder includes a housing containing an air or electrically driven motor which directly drives a grinding wheel attached thereto. The housing generally includes at least one handle which assists the operator in moving and positioning the grinder and a guard which substantially encloses the grinding wheel and protects the operator from inadvertent contact with the grinding wheel.

The design parameters and operational requirements of grinders are relatively well established. One of the primary areas of concern is overspeed of the grinding wheel. All grinding wheels are rated for a maximum r.p.m. and it is incumbent upon tool designers to incorporate speed governors into their equipment to prevent rotational speeds in excess of these maximum rated grinding wheel speeds. Numerous devices and patents are directed to achieving speed governing and overspeed shutdown. Since the grinding wheels in such tools may rotate at 6000 and as much as 8000 r.p.m., the need to control rotational speeds is manifest.

Another problem related to high speed and the substantial rotational kinetic energy which the grinding wheel possesses at such speeds involves the motor and drive mechanism. Generally, grinders include a threaded shaft upon which the grinding wheel and various washers are placed and retained by a mating nut which is threaded onto the shaft and tightened against the wheel and washers. The thread direction on the drive shaft is such that relative rotation between the grinding wheel washers and nut produced by frictional drag of the grinding wheel against a surface causes the nut to tighten against the grinding wheel and washers rather than loosen. In a like fashion, if the grinding wheel and nut are loose, start-up of the drive shaft will tend to tighten rather than loosen the nut.

Unfortunately, the opposite operating conditions produce the opposite result. That is, a slowing or rapid stop of the motor and drive shaft relative to the grinding wheel tends to loosen and unthread the retaining nut and loosen the grinding wheel. Given the substantial kinetic energy present in the rapidly rotating mass of the grinding wheel, it is clear that not only does it contain sufficient energy to unthread the retaining nut but also to inflict substantial damage to whatever object it encounters if it dislodges from the drive shaft.

SUMMARY OF THE INVENTION

The instant invention comprises a free-wheeling clutch and relatively loose slip clutch in parallel between the rotor of the drive motor of a grinder and the drive shaft thereof. Under normal operating conditions, the motor rotor is generating rotary energy in a direction which locks up the free-wheeling clutch. Energy is thus transferred from the rotor through the clutch to the drive shaft and the slip clutch is not functioning as such. Should the motor rotor malfunction and slow rapidly or stop, the free-wheeling clutch disconnects the drive shaft from the rotor while the slip clutch provides controlled drag therebetween and brings the grinding wheel to a controlled stop. The clutch mechanism thus eliminates the situation wherein the drive shaft is suddenly stopped due to a malfunction of the motor while the grinding wheel continues to rotate, unthreads the retaining fastener and dislodges from the drive shaft.

The free-wheeling clutch portion of the clutch mechanism may be a sprag-type clutch or one of a number of other one-way or free-wheeling type devices intended to be mounted concentrically between a drive and driven element. The slip clutch portion of the clutch mechanism may be of various resilient materials, such as rubber, and is sized to interfere slightly with the drive shaft. The combination of material and degree of interference fit may be varied to provide the required frictional coupling to slow and stop the grinding wheel in accordance with industry standards or the dictates of a particular application.

It should be apparent that the effect of the slip clutch may be reduced to the point where the frictional coupling between the rotor and shaft is zero, such that the grinding wheel will coast until its kinetic energy is absorbed by frictional losses within the supporting bearings and to the air. It should be understood that such a variation is deemed to be an alternate embodiment of the instant invention.

It should also be apparent that the precise position of the overrunning clutch assembly is of little significance so long as it is functionally positioned between the driving means and the shaft upon which the grinding wheel is mounted. An alternate embodiment of the instant invention is also disclosed in which the overrunning clutch mechanism is positioned at one end of and external to the motor itself. Such a design functions in a fashion identical to the preferred embodiment but may have certain manufacturing or service advantages separate and apart from the invention itself which encourage its utilization.

Finally, it should be understood that although the invention is generally described in relation to a vertical grinder, it is fully adaptable to and confers all benefits upon larger, heavier and even stationary grinder units.

Thus, it is an object of the instant invention to provide a safety device for use in grinders which allows the grinding wheel to free-wheel subsequent to a malfunction within the grinder drive motor.

It is a further object of the invention to provide for the controlled reduction of rotational speed and eventual cessation of motion of a grinding wheel subsequent to the malfunction of a drive motor.

It is a still further object of the instant invention to improve the reliability and failure characteristics of grinding machines. Further characteristics and object of the instant invention will be apparent by reference to the following specification and drawings.

BRIEF DESCRIPTION OF THE DRAWINGS

FIG. 5 is a partial sectional, side elevational diagrammatic view of a grinder employing an alternate embodiment of the instant invention; and FIG. 6 is a full sectional plan view of an overrunning clutch assembly of the alternate embodiment of the instant invention, taken along line 6—6 of FIG. 5.

DESCRIPTION OF THE PREFERRED EMBODIMENTS

Figure 1:
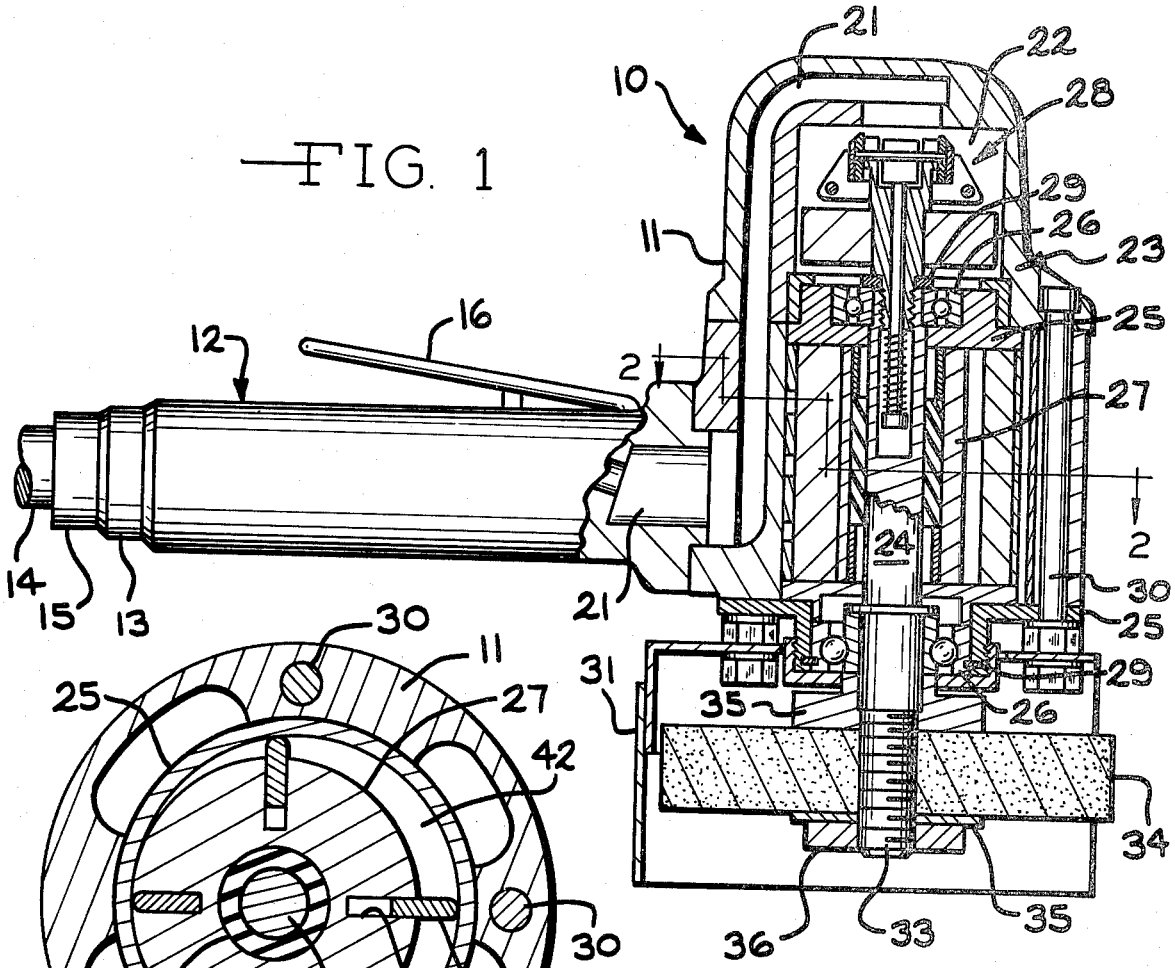
FIG. 1 is a partial sectional, side elevational diagrammatic view of a vertical grinder according to the instant invention.

Referring now to FIG. 1, a vertical grinder incorporating the instant invention is illustrated and generally designated by the reference numeral 10. The grinder 10 includes a generally cylindrical housing 11 having a radially extending handle assembly 12. The handle assembly 12 includes an inlet fitting 13 at its terminus. An air hose 14 having a suitable fitting 15 which mates with the inlet fitting 13 supplies compressed air to the vertical grinder 10. The handle assembly 12 further includes an actuation lever 16 which is linked to a control valve assembly (not shown). When the actuation lever 16 is depressed, the valve assembly supplies air to the drive components of the vertical grinder 10.

The handle assembly 12 and housing 11 define a passageway 21 which leads from the valve assembly to a motor cavity 22 within the housing 11. Positioned within the motor cavity 22 is a substantially conventional vane type air motor 23. The air motor 23 includes a drive shaft 24 which is secured within a generally cylindrical frame 25 by a pair of anti-friction bearings 26. The anti-friction bearings 26 may be of any conventional configuration, such as the ball bearing devices illustrated. Disposed coaxially about the drive shaft 24 and generally intermediate the two anti-friction bearings 26 is a motor rotor 27. The vane type air motor 23 further includes a governor and overspeed assembly 28 positioned within the cylindrical frame 25 by means of retaining rings 29 and this entire assembly is, in turn, retained within the housing 11 by a plurality of elongate threaded fasteners 30. The threaded fasteners 30 also secure a generally cylindrical guard 31 to the housing 11. The drive shaft 24 extends beyond the cylindrical frame 25 and into the space defined by the guard 31. This portion of the shaft 24 has threads 33 adjacent its terminus. Positioned on the threaded portion 33 of the drive shaft 24 is a grinding wheel 34. The grinding wheel 34 is retained on the drive shaft 24 by a pair of washers 35 and a threaded retaining nut 36. The direction of the threads 33, i.e. left-handed or right-handed, is significant. If the air motor 23 rotates in the clockwise direction, the threads 33 should be right-handed such that drag of the grinding wheel 34 or start up of the air motor 23 tends to tighten the nut 36. Conversely, if the air motor 23 rotates counter-clockwise, the threads should be left-handed, such that drag or start up conditions will again tend to tighten the retaining nut 36 on the drive shaft 24.

Figure 2:
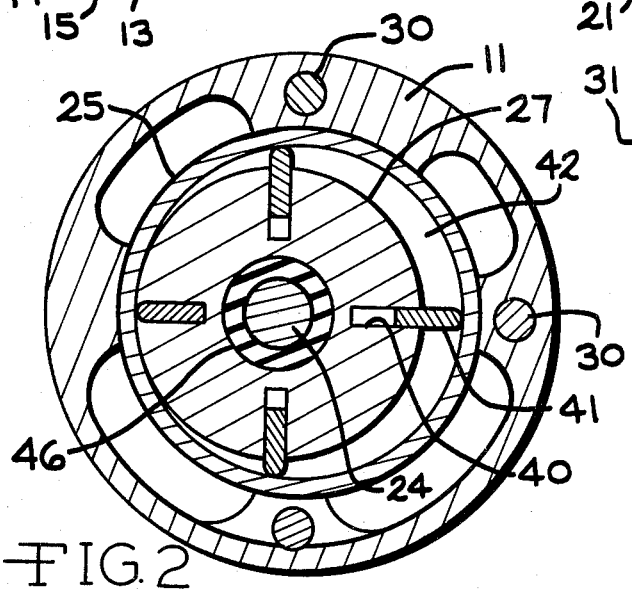
FIG. 2 is a full sectional plan view of a vertical grinder taken along line 2—2 of FIG. 1.

Referring now to FIG. 2, the motor rotor 27 positioned within the cylindrical frame 25 and housing 11 is illustrated. The motor rotor 27 includes a plurality of radially disposed channels 40 within which a like plurality of vanes 41 are positioned. The vanes 41 slide radially within the channels 40 and maintain sliding frictional contact with the inner surface of the cylindrical frame 25. The motor rotor 27 is positioned concentrically about the drive shaft 24 and these two components are positioned eccentrically within the cylindrical frame 25. The expansion of compressed air within variable volume chambers 42 formed by the cylinder frame 25, the motor rotor 27 and the vanes 41 causes the drive shaft 24, the motor rotor 27 and the vanes 41 to rotate. Inlet and outlet ports (not shown) direct the flow of compressed and exhaust air into and out of the chambers 42, respectively. With the exception of the free-wheeling clutch assembly, which will be described next, the power generation aspects of the vane type air motor 23 are conventional and thus will not be further described.

Figure 4:
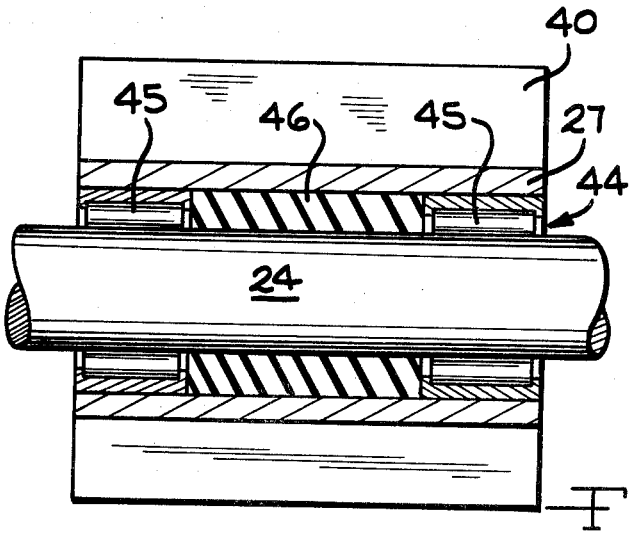
FIG. 4 is a full sectional side elevational view of a vertical grinder motor rotor incorporating the instant invention taken along line 4—4 of FIG. 3.

Referring now to FIGS. 2 and 4, a means for slowing the drive shaft 24 and grinding wheel 34 and bringing them to a controlled stop will be described. Positioned between the drive shaft 24 and the motor rotor 27 and coaxially aligned therewith is a free-wheeling clutch assembly 44. The clutch assembly 44 includes two one-way or over-running clutch assemblies 45. The clutch assemblies 45 are unitary devices which mount between two concentric rotatable assemblies and lock to transmit power between the assemblies when subjected to relative rotation in one direction and unlock to allow free-wheeling when subjected to relative rotation in the opposite direction. Such devices are well-known in the art and may be like or similar to units manufactured by the Torrington Co. or the Fafnir Bearing Co. Disposed between both the clutch assemblies 45 and the drive shaft 24 and rotor 27 is a slip clutch annulus 46. The annulus 46 may be of any resilient material such as rubber and may be sized to effect some degree of interference fit between its inner diameter and the drive shaft 24 and its outer diameter and the motor rotor 27. It should be apparent that the degree of interference fit of the clutch annulus 46 will effect the degree of frictional coupling between the motor rotor 27 and the drive shaft 24. The components of the free-wheeling clutch assembly 44, namely, the clutch assemblies 45 and the clutch annulus 46 are thus mechanically in parallel between the drive shaft 24 and the motor rotor 27. Relative rotation between the shaft 24 and the rotor 27 in one direction will cause the clutch assemblies 45 to lock and transfer rotary power between the components, up to the torque limits of the clutch assemblies 45. With relative rotation between the shaft 24 and the rotor 27 in the opposite direction, the clutch assemblies 45 will release and the mechanical coupling between these two components will be only that provided by the clutch annulus 46. As was previously pointed out, this mechanical coupling can be varied widely by adjusting the degree of interference fit as well as by selecting different materials for the clutch annulus 46.

Figure 3:
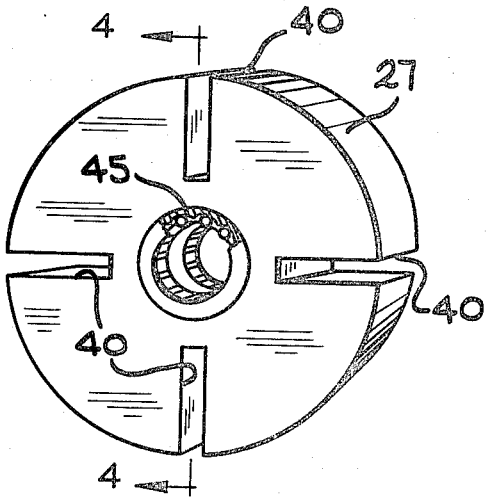
FIG. 3 is an enlarged perspective view of a vertical grinder motor rotor incorporating the instant invention.

Such free-wheeling clutch assemblies typically comprise a plurality of small roller bearings and ramps, as is shown diagrammatically in FIG. 3. Subjected to relative rotation in one direction, the roller bearings are urged up the ramp and wedge themselves between the ramp and the opposite wall of the clutch assembly thus locking the inner and outer concentric components of the clutch assembly together and transmitting power therebetween. In the reverse direction, the roller bearings tend to roll to the foot of the ramps and the concentric clutch elements free-wheel. Generally, the drive shaft 24 and motor rotor 27 are sized such that the clutch assemblies 45 will be a force or frictional fit therebetween. Thus, no retention means for use in connection with such clutch assemblies is illustrated or required.

The true nature of the instant invention is best explained by summarizing the operation of a grinder. In a grinder having a motor that rotates in the clockwise direction as viewed in FIG. 2, the threads 33 on the drive shaft 24 must be right-handed such that normal operation of the grinder 10 will result in the tightening of the nut 36 as has been previously described. Conversely, if the drive shaft 24 rotates counter-clockwise, the threads 36 must be left-handed. Returning to the former, i.e. clockwise rotation motor example, start up on the motor (which will normally subject the grinding wheel 34 to relatively rapid acceleration) or normal use of the grinder 10 will tend to tighten the retaining nut 36. However, should the air motor 23 malfunction and suddenly stop rotating, perhaps due to jamming of one of the vanes 41, the grinding wheel 34 will tend to maintain its rotation because of its substantial kinetic energy. It is possible that such kinetic energy will be sufficient to unthread the retaining nut 36 and allow the grinding wheel 34 to dislodge. A grinder incorporating the instant invention will not exhibit this behavior during this failure mode. Rather, if the rotor 27 stops suddenly, the clutch assembly 44 will allow the drive shaft 24 and grinding wheel 34 to free-wheel in a controlled fashion and come to a safe stop with the retainer nut 36 and the grinding wheel 34 still tightly secured to the drive shaft 24. It should be apparent that incorporation of the clutch assembly 44 will not affect the performance of the grinder under normal operating conditions in any manner. When the grinder is operating properly, the clutches 45 will be locked, and power from the motor rotor 27 will be transferred to the drive shaft 24 and to the grinding wheel 34.

An alternate embodiment of the instant invention is illustrated in FIGS. 5 and 6. Due to various considerations such as simplicity of manufacture, overall ruggedness and ease of repair, it may be advisable to remove the free-wheeling clutch from the interior of the motor rotor and locate it externally thereto.

In FIG. 5, a grinder 50 is illustrated which is similar in most respects to the grinder 10 illustrated in FIGS. 1–4. The grinder 50 includes a housing 51 which surrounds and protects a motor 52 having a rotor 53. The rotor 53 is tightly secured to an output shaft 54 which passes through and is freely rotatably positioned in the housing 51 by a pair of anti-friction bearings 55, such as roller bearings, one of which is shown in FIG. 5. The rotor 53 is acted upon by forces, for example, magnetic or air pressure related forces, which cause it and the shaft 54 to rotate.

The terminus of the output shaft 54 defines a concentric blind reentrant opening 56. Disposed coaxially to and adjacent the terminus of shaft 54 is a stub shaft 60. The stub shaft 60 includes a concentric annular cavity or channel 61 which defines a coaxially oriented cylindrical stub or projection 62.

Concentrically disposed between the wall of the opening 56 and the cylindrical projection 62 is an antifriction bearing 63 which is preferably a roller bearing. Another antifriction bearing 64 which functions as a thrust bearing is disposed concentrically about the axis of the shaft 60 and the projection 62 and between an axial face proximate or coplanar with the terminus of the shaft 54 and the axial (bottom) face of the cavity 61. Thus, the stub shaft 60 is axially and radially rotationally isolated from the output shaft 54 and may rotate freely with respect thereto, even when an axial force is applied to it.

An additional antifriction bearing 68 which is preferably a ball bearing is disposed between the stub shaft 60 and a cylindrical cover 70. The cover 70 includes an opening 71 through which the stub shaft 54 passes and is removably mounted to the housing 51 by means of interengaging male threads 72 and female threads 73 on the housing 51 and the inner surface of the cover 71, respectively. An oil seal 74 is positioned between the edge of the opening 71 in the cover 70 and the stub shaft 60. The oil seal 74 retains lubricant contained within the cover 70 and prevents dust and debris from entering and contaminating the lubricant and components therein.

The distal end of the stub shaft 60 includes a region of male threads 76 onto which a first threaded collar 77, a grinding wheel 78 and a second threaded collar 79 are secured. The grinding wheel 78 is thus tightly retained on or released from the shaft 60 by rotating the collars 77 and 79 towards or away from one another in a conventional manner.

Referring now to FIG. 6, an alternate embodiment of the free-wheeling or overrunning clutch assembly is illustrated. The periphery of the enlarged diameter portion of shaft 54 defines a plurality of ratchet teeth 81. The adjacent faces of the ratchet teeth intersect at an angle of approximately 90°.

As illustrated in both FIGS. 5 and 6, the stub shaft 60 defines an enlarged annular portion 82 disposed intermediate the housing 70 and the ratchet teeth 81. The annular portion 82 of the shaft 60 defines a radially skewed opening 83 which slidingly receives a cylindrical pawl 84. The pawl 84 is biased toward the ratchet teeth 81 by a compression spring 85 which is retained in the opening 83 by a plug 86 which is in turn retained in the opening by means of a retaining ring, mating threads or other means well known in fastener art. The opening 83 is skewed or offset from a radius line such that the radial and longitudinal surfaces of the pawl 84 seat parallel to and substantially in contact with adjacent generally perpendicular faces of the ratchet teeth 81.

It should be apparent that the alternate embodiment described above will function in a fashion which for all intents and purposes of the instant invention is identical. For example, the ratchet teeth 81 disposed on the output shaft 54 will lock the pawl 84 in the position shown in FIG. 6 as it rotates in the counter-clockwise direction. With the pawl 84 locked, as illustrated, rotary power will be transferred to the stub shaft 60 and to the grinding wheel 78. If, during operation, the motor 52 should malfunction and the output shaft 54 slow or stop suddenly, the ratchet teeth 81 will be rotating at a slower speed than the annular portion 82 of the stub shaft 60 and the pawl 84 will retract to allow the stub shaft 60 and grinding wheel 78 to continue to rotate.

It should be appreciated that the frictional coupling between the motor output shaft 54 and the stub shaft 60 can be varied by modifying certain of the free-wheeling clutch components. The frictional coupling is first of all a function of the biasing force produced by the compression spring 85. By modifying the spring constant of the spring 85 or by varying the compression of the spring 85 by repositioning the plug 86, the force which the pawl 84 exerts against the ratchet teeth 81 and thus the degree of rotational coupling can be adjusted. Somewhat analogously, the coupling between the shaft 54 and the shaft 60 can be adjusted by varying the number and depth of the ratchet teeth 81. In view of the conventional and obvious nature of such a variation, it will not be further described. It should, therefore, be apparent that the alternate embodiment of the instant invention also incorporates means for varying the functional coupling of the free-wheeling clutch assembly.

Although the foregoing description has addressed itself to the incorporation of the instant invention in a grinder having a vane type air motor driven by compressed air, it should be apparent that the invention, residing as it does in the free-wheeling clutch assembly 44, is easily adaptable for use in any size or style grinder utilizing either an air or electric motor. As the preferred embodiment teaches, the device is positioned between the motor rotor and the drive shaft of said motor. Alternately, the device may be positioned between the motor output and the structure upon which the grinding wheel is mounted. In both embodiments, the function of the clutch assembly is the same. It should also be apparent that the mechanical considerations regarding the degree of frictional coupling between the drive shaft and motor rotor are fully analogous whether applied to a large or small, air or electric grinder utilizing the preferred or alternate embodiment of the invention.

Finally, in regard to either a vertical grinder incorporating a vane type motor powered by compressed air or an electric motor powered by electricity, it should be apparent that the frictional coupling between the shaft and rotor may be reduced to zero such that the grinding wheel and shaft will be slowed only by the frictional losses of the bearings and air. Such a free-wheeling clutch assembly therefore would include only the one-way clutches 45 and not require the inclusion of an annulus of material which was previously referenced by numeral 46. Such a clutch assembly is deemed to be an alternate embodiment of the instant invention.

It will be appreciated that various other modifications and changes may be made in the above-described preferred embodiments of the invention without departing from the spirit and the scope of the following claims.

What I claim is:

1. A vertical grinder comprising, in combination, a motor having a rotor and stator, a grinding wheel, a drive shaft operably connected to said grinding wheel and means for coupling said motor rotor to said drive shaft, said means including mechanically parallel slip clutch means for frictionally engaging said rotor and said shaft and overrunning clutch means for achieving power transfer from said motor rotor to said drive shaft and inhibiting power transfer from said shaft to said rotor said slip clutch means including at least one clutch annulus disposed between said shaft and said rotor.

2. The vertical grinder of claim 1, wherein said coupling means is positioned concentrically within said motor rotor.

3. The vertical grinder of claim 1, wherein said overrunning clutch means comprises two overrunning clutches positioned concentrically within said motor rotor and adjacent its ends.

4. The grinder of claim 1, wherein said clutch annulus is generally elongate and fabricated of a resilient material.

5. A grinder comprising, in combination, means for generating rotary power including a rotor defining a centrally disposed passageway, a shaft positioned within said passageway, a grinding wheel mounted upon said shaft, clutch means disposed between said rotor and said shaft for rotationally locking said means for generating rotary power to said shaft upon relative rotation between said rotor and shaft in one direction and rotationally releasing said means for generating rotary power from said shaft upon relative rotation between said rotor and said shaft in the opposite direction and a slip clutch annulus concentrically disposed between said shaft and said rotor.

* * * * *